US007537003B2

(12) United States Patent
Iwamoto

(10) Patent No.: US 7,537,003 B2
(45) Date of Patent: May 26, 2009

(54) BUILT-IN KITCHEN APPARATUS

(75) Inventor: Masayuki Iwamoto, Osaka-fu (JP)

(73) Assignee: Sharp Kabushiki Kaisha, Osaka (JP)

( * ) Notice: Subject to any disclaimer, the term of this patent is extended or adjusted under 35 U.S.C. 154(b) by 47 days.

(21) Appl. No.: 11/335,792

(22) Filed: Jan. 19, 2006

(65) Prior Publication Data

US 2006/0191925 A1 Aug. 31, 2006

(30) Foreign Application Priority Data

Feb. 15, 2005 (JP) ..... 2005-037477

(51) Int. Cl.
*F24C 15/20* (2006.01)
*H05B 6/64* (2006.01)

(52) U.S. Cl. ..... 126/299 R; 219/757

(58) Field of Classification Search ..... 126/299 R, 126/301; 219/757, 756, 754, 752
See application file for complete search history.

(56) References Cited

U.S. PATENT DOCUMENTS 6,150,648 A * 11/2000 Kang et al. ..... 219/757
6,509,556 B2 * 1/2003 Kim ..... 219/757
6,528,774 B2 * 3/2003 Lee ..... 219/757
6,586,716 B1 * 7/2003 Lee ..... 219/757
6,621,058 B1 * 9/2003 Kim ..... 219/757
6,864,472 B2 * 3/2005 Kang ..... 219/757
6,900,424 B2 * 5/2005 Arntz et al. ..... 219/746
6,972,398 B2 * 12/2005 Kang ..... 219/757
7,161,125 B2 * 1/2007 Yoshidome et al. ..... 219/756
2004/0200831 A1 * 10/2004 Shozo et al. ..... 219/757

FOREIGN PATENT DOCUMENTS

JP 2000-274693 10/2000
JP 2005-003316 1/2005

* cited by examiner

*Primary Examiner*—Kenneth B Rinehart
*Assistant Examiner*—Chuka C Ndubizu
(74) *Attorney, Agent, or Firm*—Renner, Otto, Boisselle & Sklar, LLP

(57) ABSTRACT

A kitchen apparatus body installed in a cabinet includes a heating chamber configured to carry out processing, such a high-frequency heating, on an object to be processed. The kitchen apparatus body includes an air supply unit configured to suck in cooling air, a first exhaust unit configured to exhaust air including the heat from the heating chamber, and a second exhaust unit configured to exhaust air used to cool a unit, such as a high-voltage transformer, having a high temperature. The air supply unit and the first and second exhaust units are collectively disposed in a side section of the kitchen apparatus body in a manner such that they extend from the front to back and such that the inlet and the outlets open to the front surface. Therefore, the air supply and the exhaust are separated from each other so as to improve their efficiency. Even when vapor is included in the exhaust air, condensation can be prevented.

3 Claims, 4 Drawing Sheets

BUILT-IN KITCHEN APPARATUS

The present application is based on and claims priority of Japanese patent application No. 2005-037477 filed on Feb. 15, 2005, the entire contents of which are hereby incorporated by reference.

BACKGROUND OF THE INVENTION

1. Field of the Invention

The present invention relates to a built-in kitchen apparatus, such as a microwave oven, an electric oven, or a dish washing and drying machine, that is installed in a cabinet as an independent apparatus or a component of a composite cooking apparatus.

2. Description of the Related Art

A known cooking apparatus, such as a microwave oven, having a heating unit is provided as one of a cooking apparatus constituting an integrated kitchen system. Recently, as a result of kitchens being increased in size and formed as systems, diversification and unitization of cooking apparatuses have been promoted. Accordingly, a built-in apparatus configured by combining a cooktop, a pull-out microwave oven, an electric oven, and the like has been proposed. Many cooking apparatuses having a door that opens and closes the front of the apparatus have been proposed. In addition to such cooking apparatuses, pull-out cooking apparatuses that can be pulled out forward have been proposed.

An example of a built-in cooking apparatus is shown in the perspective view in FIG. 4. As shown in FIG. 4, the built-in cooking apparatus is, for example, a cooking apparatus provided adjacent to other apparatuses in a kitchen and, more specifically, is a composite cooking apparatus 30 including a cooktop unit 31, a microwave oven unit 32, and an electric oven unit 33, all being vertically aligned at a front panel 35. The cooking apparatus is a built-in apparatus and is installed in a kitchen cabinet 37 having the cooktop unit 31 on the upper surface. The cooktop unit 31 may include a drawer 34 configured to store utensils used for cooking. The microwave oven unit 32 and the electric oven unit 33 may be provided as drawers that can be pulled out. The microwave oven unit 32 includes a cooking apparatus body 1 having an overall rectangular shape, a cover 7 that can be operated to pull out a drawer body from the cooking apparatus body 1 and that is disposed at the front of the cooking apparatus body 1 so as to close a heating chamber 2, and an operation panel 8 disposed at the front of the cooking apparatus body 1 and above the cover 7. The operation panel 8 is provided as a unit with the cooking apparatus body 1. The electric oven unit 33 also has a cover 36 that can be pulled out.

A known cooking apparatus may include a heater for roasting, a magnetron for high-frequency heating, an exhaust path connecting the outside of a cooking apparatus body and a heating chamber, an exhaust fan for ventilation that is disposed in the exhaust path, and a catalyst for removing odor and smoke that is disposed in the exhaust path between the heating chamber and the exhaust fan. The known cooking apparatus is capable of reducing a first amount of air flowing from the heating chamber through the exhaust path by the exhaust fan during roasting to an amount less than a second amount of air flowing from the heating chamber through the exhaust path by the exhaust fan during high-frequency heating so as to increase the efficiency of heating and odor and smoke removal during roasting and to efficiently exhaust water vapor that is generated during high-frequency heating (refer to Japanese Unexamined Patent Application Publication No. 2000-274693, paragraphs [0060] to [0069] and FIGS. 1 to 7).

A built-in microwave oven including an electromagnetic cooking device, a microwave oven unit, and a supporting base may have a cooling structure including a control panel at the upper front, an air supply grill 73 directly below the control panel, and an exhaust grill at the lower front (refer to Japanese Unexamined Patent Application Publication No. 2005-3316, paragraphs [0002] to [0008] and FIGS. 9 and 10). According to such type of microwave oven, upper and lower heaters are provided inside, an upper inner path where air flows through due to an upper-heater-cooling fan is provided at a section including the upper heater, and a cooling path where air flows through due to a lower-heater-cooling fan is provided at a section including the lower heater. Part of the air sucked in by the upper air supply grill is directly provided in front of the exhaust grill and mixed with the air heated by passing through the heaters so as to reduce the temperature of the heated air. Then, the mixed air is exhausted from the exhaust grill.

A kitchen apparatus, such as a built-in microwave oven, including a heating unit that is heated to a high temperature includes a cooling unit for cooling the heating unit. Usually, the cooling unit has an air cooling structure configured to cool the heating unit by introducing cooled air. The cooling structure of a known built-in microwave oven, as described above, is provided separately in the microwave oven as an upper (lower) section for air supply and a lower (upper) section for exhaust. If the air supply and exhaust are provided separately in upper and lower sections, the sections provided for air supply and exhaust become bulky. Thus, the space for the heating chamber must be reduced since the overall height of the apparatus is limited. As a result, the storage efficiency of the cabinet is reduced and the flexibility in the design of the built-in cooking apparatus is limited. If the air supply and exhaust are provided separately as left and right sections, there is a problem in that the width of the apparatus will be limited due to the reason similar one limiting the height. If the air supply and exhaust units are provided in the same section, there is problem in that mixing of cold air and warm air will occur, and the apparatus will have a structure that is significantly disadvantageous for cooling electric components.

Accordingly, there are problems to be solved when preventing the bulkiness of the kitchen apparatus by disposing an air supply unit for cooling air and an exhaust unit for exhausting high-temperature air after receiving the heat generated during processing an object to be processed.

SUMMARY OF THE INVENTION

Accordingly to the present invention, a built-in kitchen apparatus that is installed in a cabinet as an independent apparatus or a component of composite cooking apparatus is provided, wherein the built-in kitchen apparatus combines an air supply unit and an exhaust unit, improves the efficiency of air supply and exhaust, improves the efficiency of cooling electric components and exhausting air in the chamber, and reduces the limits on the design and installation position of the kitchen apparatus.

To solve the above-identified problems, the present invention provides a built-in kitchen apparatus including a kitchen apparatus body being installed in a cabinet and having a processing chamber capable of accommodating an object to be processed, an air supply unit configured to suck in air for cooling, and an exhaust unit connected to the air supply unit to exhaust the air that is heated by the heat generated when processing the object to be processed from the air supply unit.

The air supply unit and the exhaust unit are collectively disposed at one side section of the kitchen apparatus body in a manner such that an inlet of the air supply unit and outlets of the exhaust unit open on the front surface of the kitchen apparatus body.

According to this built-in kitchen apparatus, the object to be processed is disposed in the processing chamber provided in the kitchen apparatus body installed in the cabinet. When the kitchen apparatus is operated, heat is generated due to thermal processing carried out on the object to be processed in the processing chamber. For a built-in kitchen apparatus that is installed, there is nowhere for the heat to escape, and, thus, the generated heat must be actively exhausted outside the apparatus. The generated heat is transmitted to the cooling air sucked in at the air supply unit and is exhausted outside the apparatus together with the air exhausted from the exhaust unit. More specifically, the cooling air sucked in from the inlet in the front is first sent to the back of the kitchen apparatus body and then, after receiving the heat generated when processing the object to be processed, is sent from the back to the front of the kitchen apparatus body so as to be exhausted. Since the air supply unit and the exhaust unit are collectively disposed at one side section of the kitchen apparatus body in a manner such that the inlet of the air supply unit and the outlets of the exhaust unit open on the front surface of the kitchen apparatus body, the space required for the air supply unit and the exhaust unit for cooling is reduced. Furthermore, since the air supply unit and the exhaust unit are disposed separately at one side section and the supplied air and the exhaust air do not mix, the efficiency of air supply and exhaust is improved, the efficiency of cooling the electric components and ventilating the chamber is improved, and limitations are reduced by improving the flexibility of the design and positioning of the kitchen apparatus.

According to this built-in kitchen apparatus, it is preferable that the air supply unit and the exhaust unit are disposed at different ends of the same side section of the kitchen apparatus body. Since the air supply unit and the exhaust unit are disposed on the same side section, the mixing of supplied air and exhaust air can be prevented even more reliably by separating the air supply unit and the exhaust unit. According to the built-in kitchen apparatus, the side section where the air supply unit and the exhaust unit are disposed may be a lower section of the kitchen apparatus body. However, of course, the side section may be other sections, such as an upper section, a left section, or a right section.

According to the built-in kitchen apparatus, the kitchen apparatus body includes a heat source used for thermal processing of the object to be processed, and the exhaust unit includes a first exhaust unit connected to the processing chamber and configured to exhaust air flowing from the processing chamber and a second exhaust unit disposed parallel to the first exhaust unit and configured to exhaust air used to cool the heat source. Since the air flow from the processing chamber becomes hot due to the thermal processing carried out on the object to be processed or includes hot air, such as vapor generated at the processing chamber, the first exhaust unit exhausts such high-temperature air. When the temperature of the heat source becomes high, the air flow from the processing chamber comes into contact with the heat source and receives heat so as to cool the heat source. As a result, hot and dry air is exhausted from the second exhaust unit.

According to the built-in kitchen apparatus including an exhaust unit having first and second exhaust units, the second exhaust unit may be disposed along the longitudinal direction of the side section with respect to the first exhaust unit and may be disposed closer to the air supply unit. According to this arrangement, the air supply unit is not disposed adjacent to the first exhaust unit but is disposed adjacent to the second exhaust unit where hot and dry air flows through. Therefore, the air exhausted from the first exhaust unit is not affected by the low-temperature supply air.

According to this built-in kitchen apparatus, the kitchen apparatus body may include a cooling fan configured to suck in the air for cooling through the air supply unit, part or all of the air blown out of the cooling fan may be used to cool the heat source, and at least part of the air used to cool the heat source may be sent to the second exhaust unit whereas the remaining air is sent to the first exhaust unit. By providing a cooling fan in the path connecting the air supply unit and the exhaust unit of the kitchen apparatus body, cooling air is sucked in through the air supply unit. Part or all of the air blown out of the cooling fan is used to cool the heat source. In other words, part of the air from the cooling fan may be directly sent to the processing chamber. Part of the air used for cooling the heat source may be sent to the second exhaust unit and the remaining air may flow to the first exhaust unit. Accordingly, without interrupting the air flow to the first and second exhaust units, cooling and ventilation of the processing chamber and cooling of the heat source can be continuously carried out.

According to a built-in kitchen apparatus including an exhaust unit having first and second exhaust units, the processing chamber may be a chamber configured to generate high-temperature vapor when carrying out thermal processing on the object to be processed and the first exhaust unit may be capable of exhausting the air flowing into the processing chamber and the vapor. If the air flowing through the processing chamber includes high-temperature vapor generated when the object to be processed is thermally processed, condensation due to condensing vapor does not occur.

The built-in kitchen apparatus including an exhaust unit having first and second exhaust units may further include a horizontal duct being connected to the forward upper area of the processing chamber and extending towards the back on the ceiling of the processing chamber and a connecting duct being connected to the horizontal duct and being connected to the first exhaust unit. The cooling air guided through the air supply unit and sent to the back is guided into the processing chamber from the back area. The guided air moves upward in the processing chamber and flows into the horizontal duct disposed at the ceiling of the processing chamber from the upper front area. Since the horizontal duct is extended towards the back, the air flowing into the horizontal duct immediately moves to the back. Accordingly, the high-frequency cooking apparatus and an operation unit, a control unit, and a display unit, such a panel, disposed at the front and vicinity of the high-frequency cooking apparatus are less likely to be affected by the high-temperature air flow. In this way, the apparatus will less likely be damaged.

According to the above-described built-in kitchen apparatus, the kitchen apparatus may be a composite kitchen apparatus including a high-frequency cooking apparatus configured to carry out a high-frequency heating process on an object to be heated, equivalent to the object to be processed, in a heating chamber, equivalent to the processing chamber or a high-frequency cooking unit, configured to carry out a high-frequency heating process as a component in a heating chamber, equivalent to the processing chamber, wherein the high-frequency cooking unit is included in the composite kitchen apparatus as a component. An independent high-frequency cooking apparatus or the high-frequency cooking apparatus as a component, for example, may be a microwave oven or a microwave combination oven configured to carry out microwave heating. In such a case, the object to be heated is a beverage or food to be heated. By carrying out high-frequency heating, the water included in the food is vaporized inside the heating chamber and high-temperature vapor is generated. It is preferable to not mix the air including the high-temperature vapor with the cooling air to maintain air supply and exhaust efficiencies. Furthermore, it is preferable to prevent condensation (dewing) of the high-temperature vapor by separating the section of the exhaust unit, where the high-temperature vapor flows through, with the section of the exhaust unit, where the hot and dry air obtained after cooling the high-temperature heat source flows through, and to better separate this air with the cooling air.

Since, in an installed kitchen apparatus, heat generated inside the apparatus cannot be released into the cabinet, heat generated when the processing the object to be processed in the processing chamber by operating the kitchen apparatus must be exhausted outside the apparatus through an exhaust path. According to the built-in kitchen apparatus according to the present invention, as described above, since the air supply unit and the exhaust unit are collectively disposed in one of the upper, lower, left, and right sections of the kitchen apparatus body in a manner such that the inlet of the air supply unit and the outlets of the exhaust unit open on the front surface, cooling air sucked in from the inlet on the front surface is first sent to the back of the kitchen apparatus body and then, after carrying out cooling by receiving the heat generated when processing the object to be processed, is sent from the back to the front of the kitchen apparatus body so as to be exhausted. Since the air supply unit and the exhaust unit are collectively disposed at one side section of the kitchen apparatus body, the space required for the air supply unit and the exhaust unit for cooling is reduced. Since the air supply unit and the exhaust unit are connected to each other with a single continuous path and are separated from each other in the side section, the supplied air and the exhausted air do not mix. Furthermore, when the air supply unit and the first exhaust unit for exhausting the vapor in the chamber are separated from the second exhaust unit, where the air used to cool high-temperature components flow through, rapid cooling of the vapor at the first exhaust unit can be prevented and dewing (condensation) can be prevented. In particular, when the first and second exhaust units are disposed adjacent to each other, the temperature of the air flowing through the first exhaust unit is increased by the air flowing through the second exhaust unit so as to prevent condensation even more efficiently. In other words, the vapor is exhausted outside the built-in apparatus without causing the vapor to be condensed into water drops inside the built-in kitchen apparatus. In this way, according to the built-in kitchen apparatus installed inside a cabinet as an independent apparatus or a component of a composite cooking apparatus, the efficiency of air supply and exhaust is improved, the efficiency of cooling electric components and exhausting air in the chamber is improved, and the limits on the design and installation position of the kitchen apparatus are reduced.

DESCRIPTION OF THE PREFERRED EMBODIMENTS

A built-in kitchen apparatus according to an embodiment of the present invention will be described below with reference to the drawings. FIG. 1A is a schematic view of the air flow inside a high-frequency heating device. FIG. 1B illustrates the air flow shown in FIG. 1A in a lower section viewed from the top.

Figure 1:
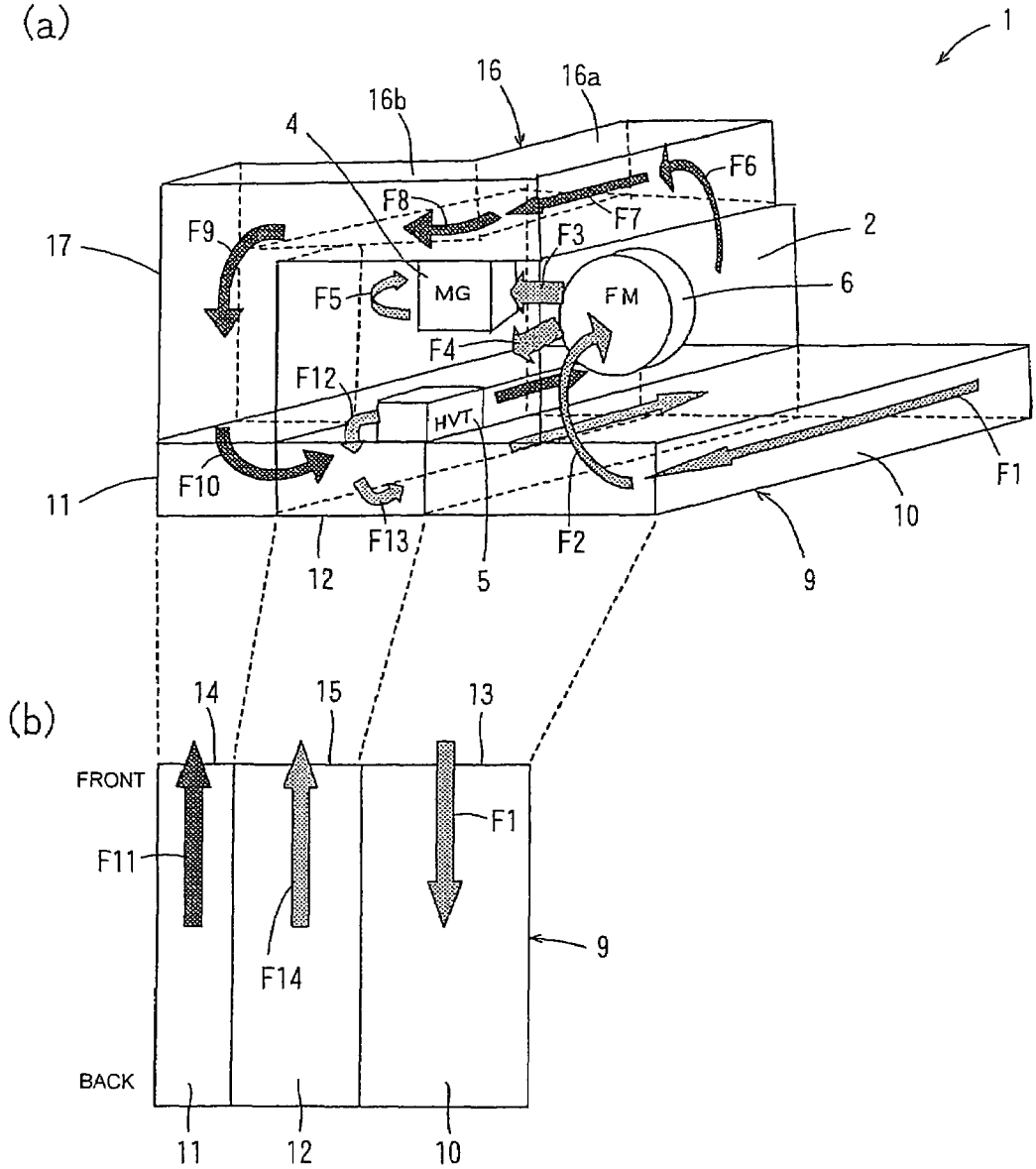
FIG. 1 is a schematic perspective view illustrating the air flow in a built-in kitchen apparatus according to an embodiment of the present invention.
Figure 2:
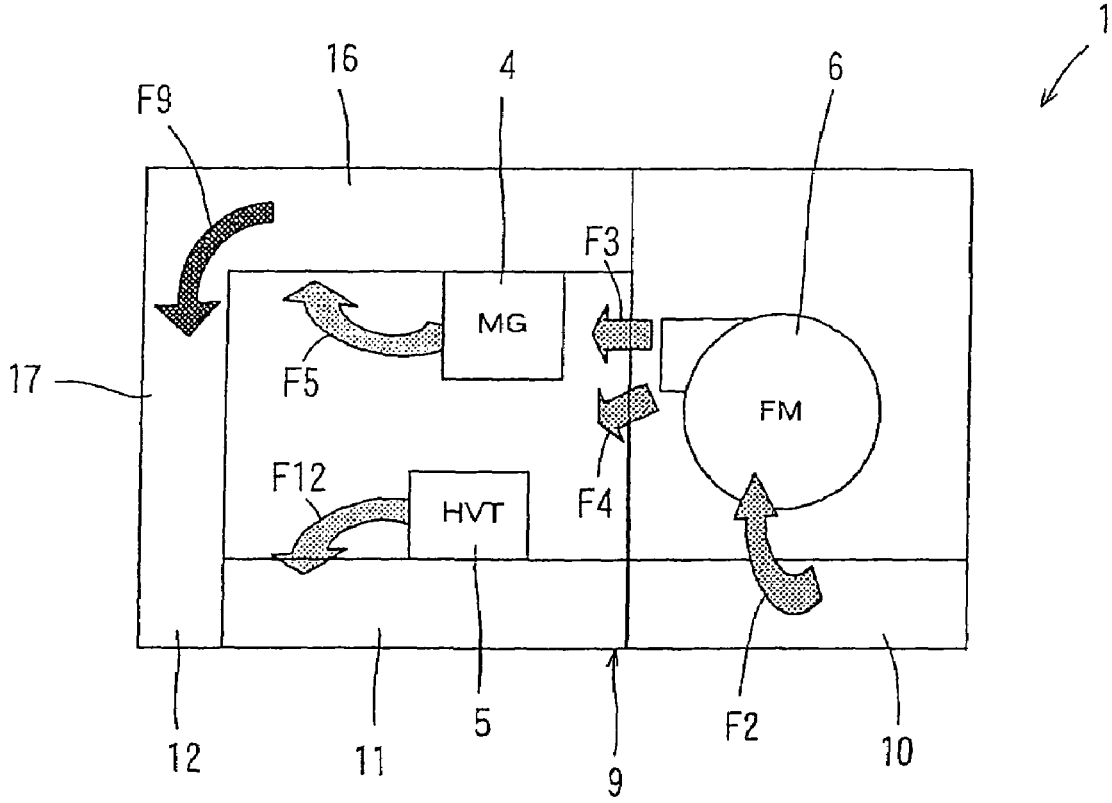
FIG. 2 is a schematic view illustrating the air flow from the back of the built-in kitchen apparatus according to an embodiment of the present invention.
Figure 3:
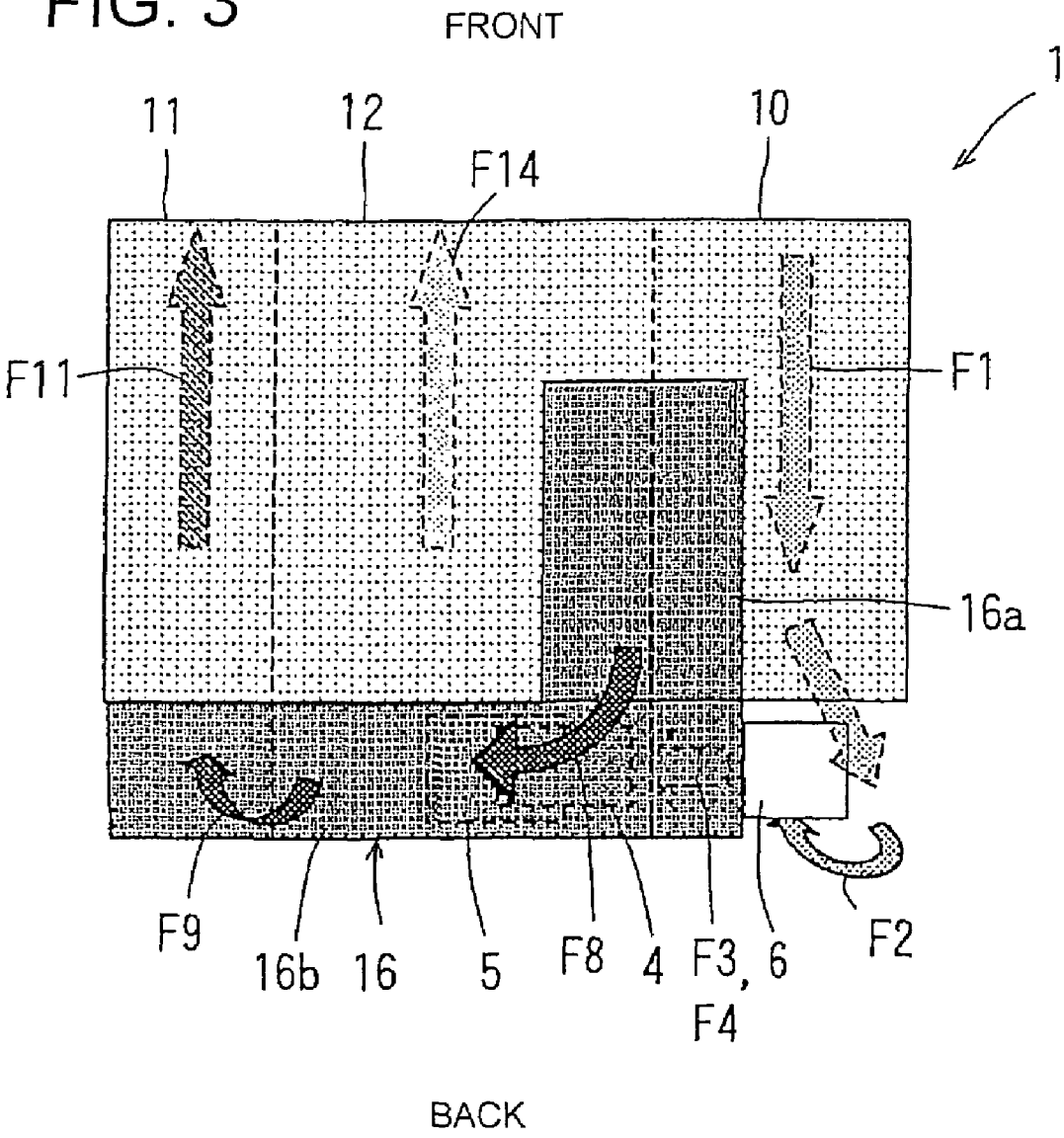
FIG. 3 is a schematic view illustrating the air flow from the top of the built-in kitchen apparatus according to an embodiment of the present invention.
Figure 4:
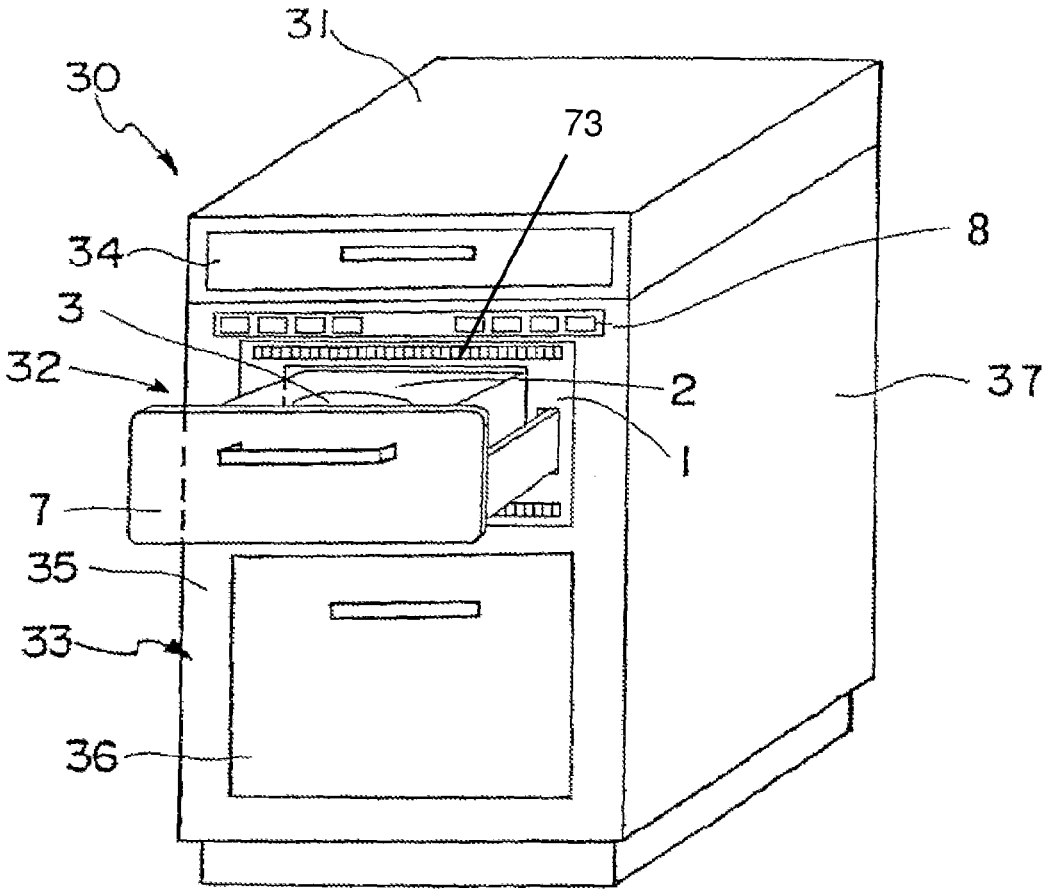
FIG. 4 is a schematic view of the exterior of a composite cooking apparatus that is an example of a built-in cooking apparatus according to an embodiment of the present invention.

The built-in kitchen shown in FIGS. 1 to 3, in detail, is a high-frequency heating apparatus such as a microwave oven whose heating chamber can be pulled out forward. Basically, an independent high-frequency heating apparatus and the high-frequency heating apparatus installed inside a cabinet as a component of a composite heating apparatus, as show in FIG. 4, may have the same structure. Therefore, the same elements are represented by the same reference numerals.

A cooking apparatus body 1 has an overall shape of a box (rectangular solid). A heating chamber 2 that is an oven box, where an object to be heated 3 (see, e.g., FIG. 4) is disposed, is provided inside the cooking apparatus body 1. At a position in the back of the cooking apparatus body 1, a magnetron 4 that is disposed in an upper section and is a microwave generator configured to heat the object to be heated 3 disposed in the heating chamber 2 with microwave, and a high-voltage transformer (HVT) 5 that is disposed in a lower section and is a high-voltage generator are provided. More specifically, the microwave generated at the magnetron 4 is transmitted through a waveguide tube, not shown in the drawings, and is emitted from a feeder into the heating chamber 2. When the high-frequency cooking apparatus is being operated, the temperatures of magnetron 4 and the high-voltage transformer 5 increase due to an electromagnetic effect. Since the water included in the object to be heated 3 is heated and vaporized when the object 3 is heated by microwave, high-temperature water vapor is generated in the heating chamber 2.

At a lower section 9 of the cooking apparatus body 1, an air supply unit 10 functioning as a duct for cooled air is provided towards a first side of the lower section 9, and a first exhaust unit 11 and a second exhaust unit 12 configured to exhaust air from the cooking apparatus body 1 are provided towards a second side of the lower section 9. An inlet 13 of the air supply unit 10, an outlet 14 of the first exhaust unit 11, and an outlet 15 of the second exhaust unit 12 open on the front surface of the cooking apparatus body 1. The air supply unit 10, the first exhaust unit 11, and the second exhaust unit 12 are provided in a manner such that they extend longitudinally from the front of the cooking apparatus body 1 to substantially the back wall of the cooking apparatus body 1. In the drawings, for simplicity, the units 10, 11, and 12 are illustrated parallel to each other. However, the units 10, 11, and 12 need only be aligned substantially parallel to each other, and their alignment may be changed in accordance with the structure of the cooking apparatus body 1.

The first exhaust unit 11, as described below, is an exhaust duct for exhausting hot air including high-temperature vapor generated at the heating chamber 2 to outside the apparatus and is disposed at a position farthest from the air supply unit 10, i.e., the outermost position. The second exhaust unit 12 is an exhaust duct for exhausting hot and dry air obtained after cooling the high-temperature magnetron 4 in the cooking apparatus body 1 and is interposed between the air supply unit 10 and the first exhaust unit 11. A cooling fan motor 6 is provided in the upper back area of the air supply unit 10 in a manner such that the inlet of the air supply unit 10 is connected with the cooling fan motor 6.

When a high-frequency cooking apparatus having the above-described structure is operated, the cooling fan motor 6 is operated and the outside air is sucked into the apparatus through the cooling fan motor 6. An air flow F1 for cooling flows through the air supply unit 10. An air flow F2 flows from the farthest area of the air supply unit 10 to the cooling fan motor 6. The air flows on the outlet side of the cooling fan motor 6 includes an air flow F3 flowing towards the magnetron 4 at the upper back area, and an air flow F4 flowing towards the high-voltage transformer 5 at the lower back area. In other words, part of the cooling air sucked in through the air supply unit 10 is blown against the magnetron 4 to cool the magnetron 4 and the rest of the cooling air is blown against the high-voltage transformer 5 to cool the high-voltage transformer 5.

The air flow F3 that cools the magnetron 4 is heated due to the heat received from the magnetron 4 during cooling of the magnetron 4 and becomes an air flow F5 that is guided to the heating chamber 2. The air flow F5 flows into the heating chamber 2 from the back side. The air that flows into the heating chamber 2 is heated more inside the heating chamber 2 and engulfs the high-temperature water vapor generated when heating the object to be heated 3. Since an air flow F6 including this water vapor rises as moving forward inside the heating chamber 2, the air flow F6 flows into an upper horizontal duct 16 of the cooking apparatus body 1. The horizontal duct 16 is disposed on the ceiling of the heating chamber 2 and has an overall L-shaped structure. The horizontal duct 16 includes a first section 16*a* extending to a position farthest in the back of the heating chamber 2 and a second section 16*b* extending in the lateral direction at the farthest back area. The horizontal duct 16 functions as a connection duct extending downwards at the back of the cooking apparatus body 1 and is connected to a vertical duct 17. Since the horizontal duct 16 extends directly towards the back at the first section 16*a* on the ceiling of the heating chamber 2, the effect of the high-temperature air flow reaching an operation unit, a control unit, and a display unit disposed on the forward surface (front surface) can be minimized. An air flow F7 flows through the horizontal duct 16, continues on as air flows F8 and F9, flows through the vertical duct 17 as an air flow F10, and finally is exhausted outside the apparatus as an exhaust flow F11 from the first exhaust unit 11.

The temperature of the air flow F4 for cooling the high-voltage transformer 5 is increased by receiving heat from the high-voltage transformer 5 during cooling, but the air flow F4 does not receive moisture. A hot and dry air flow F12 used for cooling the high-voltage transformer 5 is guided to the second exhaust unit 12 (air flow F13) and is exhausted outside the apparatus from the second exhaust unit 12 as an air flow F14. The air flow F3 for cooling the magnetron 4 and the air flow F4 for cooling the high-voltage transformer 5 do not have to be clearly separated when flowing into the first exhaust unit 11 and the second exhaust unit 12, respectively, and the air flow F5 for cooling the magnetron 4 and the air flow F12 for cooling the high-voltage transformer 5 may be combined when flowing into the first exhaust unit 11 and the second exhaust unit 12.

As described above, the cooling air flowing into the air supply unit 10 is exhausted to the outside of the apparatus from the first exhaust unit 11 and the second exhaust unit 12 through separate cooling paths inside the cooking apparatus body 1. In this way, the components inside the cooking apparatus body 1 can be efficiently cooled midway through the cooling paths. The positions of the air supply unit 10, the first exhaust unit 11, and the second exhaust unit 12 are limited to the lower section 9. However, since they have two sections aligned in the horizontal direction, the supplied air and the exhaust air can flow through separate cooling paths. Therefore, the high-temperature exhaust air flowing through the first exhaust unit 11 and the second exhaust unit 12 does not get mixed with the low-temperature supply air passing through the air supply unit 10. Since the first exhaust unit 11 and the second exhaust unit 12 are disposed adjacent to each other and the first exhaust unit 11 and the air supply unit 10 are separated from each other by the second exhaust unit 12 being interposed between the two, the high-temperature vapor flowing through the first exhaust unit 11 is not cooled by the low-temperature air flowing through the air supply unit 10. More specifically, the air flow including the high-temperature vapor flowing through the first exhaust unit 11 is heated by the high-temperature air obtained by cooling the magnetron 4. As a result, dewing (condensation) caused by the high-temperature vapor flowing through the first exhaust unit 11 being rapidly cooled as it approaches the outlet 15 is prevented. In other words, the high-temperature vapor flowing through the first exhaust unit 11 can be exhausted outside the built-in box (inside the microwave oven) without condensing into water drops.

Various modifications may be applied to the above-described embodiment of the present invention so long as these modifications are within the technical scope of the present invention. More specifically, according to the above-described embodiment, the ducts are disposed close to each other. This duct arrangement is preferable since a large air flow can be maintained. However, the arrangement of the ducts is not limited, and each duct may be disposed away from each other. According to the description above, the ducts are disposed in the lower section. However, the ducts may be collectively disposed in the upper section, the left section, or the right section. When the ducts are to be collectively disposed in the left or right section, it is preferable to collect the air supply units at the lower edge and the exhaust units at the upper edge. Moreover, the positions of the components in the cooking apparatus body 1 and the air flow design corresponding to these positions may be modified from those according to the embodiment shown in the drawings. As an embodiment of the built-in kitchen apparatus according to the present invention, a high-frequency cooling apparatus, such as a microwave oven, has been described above. However, the built-in kitchen apparatus is not limited, and it is apparent that electric ovens and dish washing and driving machines are also included. In case of a dish washing and driving machine, an object to be processed is a wet dish and the heating process is a drying process. The component configured to supply hot air is a heat source, and high-temperature vapor generated by drying the dish is exhausted through the first exhaust unit.

What is claimed is:

1. A built-in high-frequency kitchen apparatus, comprising:

a kitchen apparatus body installed in a cabinet, the body having a box shape and having a processing chamber formed inside opening at a front panel;

a heating chamber located in the processing chamber and being able to be pulled out forward from the processing chamber as a drawer;

an operation panel disposed on an upper part of the front panel of the kitchen apparatus body;

an air supply unit and an exhaust unit disposed on a lower section of the kitchen apparatus body;

a microwave generator and a high-voltage generator disposed in the kitchen apparatus body at a position in a back of the processing chamber; and a cooling fan that sends cooling air to the microwave generator and the high-voltage generator for cooling thereof, wherein, cooling air sent by the cooling fan is divided into one flow directing to the microwave generator and another flow directing to the high-voltage generator, the air supply unit extends from an inlet in a rear direction of the processing chamber to the cooling fan, the exhaust unit comprises a first exhaust unit which extends in a front direction to a first outlet and a second exhaust unit which extends in the front direction to a second outlet, the inlet and the outlets are aligned side by side and separated in a horizontal direction on the lower part of the front panel, the second outlet being disposed between the inlet and the first outlet, the one flow flows into the processing chamber from the back side thereof by way of the microwave generator, further flows out from the processing chamber at the front and upper side thereof and runs through a duct to the back side and further to a lower part of the processing chamber and is further exhausted to the first outlet by way of the first exhaust unit, and the another flow flows through the high-voltage generator and is exhausted to the second outlet by way of the second exhaust unit.

2. The built-in high-frequency kitchen apparatus according to claim 1 further comprising:

a horizontal duct being connected to the forward upper area of the processing chamber and extending towards the back on the ceiling of the processing chamber; and a connecting duct being connected to the horizontal duct and being connected to the first exhaust unit.

3. The built-in high-frequency kitchen apparatus according to claim 1, wherein, the kitchen apparatus is a composite kitchen apparatus including a high-frequency cooking apparatus configured to carry out a high-frequency heating process on an object to be heated equivalent to the object to be processed in a heating chamber equivalent to the processing chamber or a high-frequency cooking unit configured to carry out a high-frequency heating process on an object to be heated equivalent to the object to be processed in a heating chamber equivalent to the processing chamber, the high-frequency cooking unit being included in the composite kitchen apparatus as a component.

* * * * *